US007332072B2

(12) United States Patent
Germaine et al.

(10) Patent No.: US 7,332,072 B2
(45) Date of Patent: Feb. 19, 2008

(54) PROCESS TO PREPARE A WAXY RAFFINATE

(75) Inventors: Gilbert Robert Bernard Germaine, Petit Couronne (FR); David John Wedlock, Chester (GB)

(73) Assignee: Shell Oil Company, Houston, TX (US)

( * ) Notice: Subject to any disclaimer, the term of this patent is extended or adjusted under 35 U.S.C. 154(b) by 361 days.

(21) Appl. No.: 10/469,952

(22) PCT Filed: Mar. 5, 2002

(86) PCT No.: PCT/EP02/02449

§ 371 (c)(1),
(2), (4) Date: Dec. 16, 2003

(87) PCT Pub. No.: WO02/070630

PCT Pub. Date: Sep. 12, 2002

(65) Prior Publication Data

US 2004/0099571 A1 May 27, 2004

(30) Foreign Application Priority Data

Mar. 5, 2001 (EP) ..... 01400562
Aug. 16, 2001 (EP) ..... 01402181

(51) Int. Cl.
*C10G 47/00* (2006.01)

(52) U.S. Cl. ..... 208/108; 208/58; 208/950; 208/18; 208/19

(58) Field of Classification Search ..... 208/108, 208/58, 950, 18, 19
See application file for complete search history.

(56) References Cited

U.S. PATENT DOCUMENTS

| | | | | |
|---|---|---|---|---|
| 2,603,589 | A * | 7/1952 | Schaerer | 208/24 |
| 3,876,522 | A | 4/1975 | Campbell et al. | 208/58 |
| 3,965,018 | A | 6/1976 | Heilman et al. | 252/59 |
| 4,299,714 | A | 11/1981 | Sugiura et al. | 252/73 |
| 4,343,692 | A | 8/1982 | Winquist | |
| 4,574,043 | A | 3/1986 | Chester et al. | |
| 4,582,616 | A | 4/1986 | Kita et al. | 252/17 |
| 4,859,311 | A | 8/1989 | Miller | |
| 4,919,788 | A * | 4/1990 | Chen et al. | 208/59 |
| 4,943,672 | A | 7/1990 | Hamner et al. | 585/737 |
| 4,983,273 | A | 1/1991 | Kennedy et al. | 208/89 |
| 5,053,373 | A | 10/1991 | Zones | |
| 5,059,299 | A | 10/1991 | Cody et al. | 208/27 |
| 5,135,638 | A | 8/1992 | Miller | 208/27 |
| 5,157,191 | A | 10/1992 | Bowes et al. | 585/533 |
| 5,252,527 | A | 10/1993 | Zones | |
| 5,362,378 | A | 11/1994 | Borghard et al. | 208/138 |
| 5,370,818 | A | 12/1994 | Schleifstein | 252/186.25 |
| 5,372,703 | A | 12/1994 | Kamiya et al. | 208/58 |
| 5,447,621 | A | 9/1995 | Hunter | 208/58 |
| 5,456,820 | A | 10/1995 | Forbus, Jr. et al. | 208/111 |
| 5,693,598 | A | 12/1997 | Abraham et al. | 508/444 |
| 5,723,716 | A * | 3/1998 | Brandes et al. | 585/734 |
| 5,770,542 | A | 6/1998 | Brandes et al. | 502/527 |
| 5,804,058 | A * | 9/1998 | Grandvallet et al. | 208/111.1 |
| 5,856,365 | A * | 1/1999 | Zennaro et al. | 518/715 |
| 5,935,417 | A | 8/1999 | Cody et al. | 208/87 |
| 6,059,955 | A | 5/2000 | Cody et al. | 208/18 |
| 6,060,437 | A | 5/2000 | Robson et al. | 508/371 |
| 6,090,989 | A | 7/2000 | Trewella et al. | 585/13 |
| 6,103,099 | A | 8/2000 | Wittenbrink et al. | 208/27 |
| 6,165,949 | A | 12/2000 | Berlowitz et al. | |
| 6,179,994 | B1 | 1/2001 | Clark et al. | |
| 6,627,779 | B2 | 9/2003 | O'Rear | 585/302 |
| 6,642,189 | B2 | 11/2003 | Kurihara et al. | 508/364 |
| 2003/0119682 | A1 | 6/2003 | Saini et al. | 508/167 |
| 2004/0099571 | A1 | 5/2004 | Germaine et al. | 208/108 |
| 2004/0118744 | A1 | 6/2004 | Li et al. | 427/512 |
| 2004/0192979 | A1 | 9/2004 | Matthai et al. | 585/16 |

FOREIGN PATENT DOCUMENTS

| | | |
|---|---|---|
| AU | 698392 | 10/1989 |
| AU | 698392 | 9/1995 |
| EP | A0113579 | 7/1984 |
| EP | 0323092 | 7/1989 |
| EP | 426223 | 5/1991 |
| EP | 471524 | 2/1992 |
| EP | 0237655 | 6/1992 |
| EP | 0532118 | 3/1993 |
| EP | 0668342 | 8/1995 |

(Continued)

OTHER PUBLICATIONS

International Search Report dated Jul. 29, 2002.

(Continued)

*Primary Examiner*—Glenn A. Caldarola
*Assistant Examiner*—John C. Douglas

(57) ABSTRACT

A process to prepare a waxy raffinate product by
(a) hydrocracking/hydroisomerizing a Fischer-Tropsch derived feed, wherein weight ratio of compounds having at least 60 or more carbon atoms and compounds having at least 30 carbon atoms in the Fischer-Tropsch product is at least 0.2 and wherein at least 30 wt % of compounds in the Fischer-Tropsch derived feed have at least 30 carbon atoms; and,
(b) isolating from the product of step (a) a waxy raffinate product having a T10 wt % boiling point of between 200° C. and 450° C. and a T90 wt % boiling point of between 400° C. and 650° C.

12 Claims, No Drawings

FOREIGN PATENT DOCUMENTS

| | | | |
|---|---|---|---|
| EP | A0668342 | | 8/1995 |
| EP | 0666894 | | 1/1997 |
| EP | 0776959 | | 6/1997 |
| EP | A0776959 | | 6/1997 |
| EP | 0832171 | | 1/2000 |
| EP | 1102827 | | 9/2002 |
| EP | 1389635 | | 2/2004 |
| EP | 13700633 | | 8/2005 |
| EP | 1365005 | | 10/2005 |
| EP | 1366134 | | 11/2005 |
| GB | 713910 | | 8/1954 |
| JP | 401133988 | A | 5/1989 |
| WO | 94/10263 | | 5/1994 |
| WO | WO199523765 | | 9/1995 |
| WO | 96/03359 | | 2/1996 |
| WO | WO199603359 | | 2/1996 |
| WO | 97/18278 | | 5/1997 |
| WO | 97/21788 | | 6/1997 |
| WO | WO199721788 | | 6/1997 |
| WO | WO199802503 | | 1/1998 |
| WO | 99/20720 | | 4/1999 |
| WO | WO199920720 | | 4/1999 |
| WO | 99/34917 | | 7/1999 |
| WO | WO199934917 | | 7/1999 |
| WO | 00/14179 | | 3/2000 |
| WO | 00/14183 | | 3/2000 |
| WO | 00/14187 | | 3/2000 |
| WO | 00/14188 | | 3/2000 |
| WO | 00/15736 | | 3/2000 |
| WO | WO200014183 | | 3/2000 |
| WO | WO200014184 | | 3/2000 |
| WO | 00/29511 | | 5/2000 |
| WO | WO200107469 | | 2/2001 |
| WO | WO200107538 | | 2/2001 |
| WO | 01/18156 | | 3/2001 |
| WO | WO200157166 | | 8/2001 |
| WO | WO2001074969 | | 11/2001 |
| WO | WO2002064710 | | 8/2002 |
| WO | WO2002064711 | | 8/2002 |
| WO | WO2002070627 | | 9/2002 |
| WO | WO2002070629 | | 9/2002 |
| WO | WO2002070630 | | 9/2002 |
| WO | WO2002096842 | | 12/2002 |

OTHER PUBLICATIONS

Lubricant Base Oil and Wax Processing. Avilino Sequeira. Jr. , Marcel Dekker inc. , NY 1994, Chapter 7.

Lucie Coniglio and Armelle Nouviaire "A Method for Estimating the Normal Boiling Point of Heavy Hydrocarbons Suitable for a Group-Contribution-Based Equation of State". published in 2001 by the American Chemical Society . Incl . Eng. Chem. Res . 2001 . 40. 1781-1790.

Chevron Opposition Letter dated Jun. 28, 2005.

Shell MDS (Malaysia) "Manufacturing Clean Products From Natural Gas", May 1995.

Peter J.A. Tjim et al. The Markets for Shell Middle Distillate Synthesis Products. Alternate Energy '95. Vancouver Canada. May 2-4, 1995.

Affidavit of John Rosenbaum dated Nov. 4, 2004. filed in connection with opposition proceedings on EP-B-1102827.

Conversion of Natural Gas to Transportation Fuels via the Shell Middle Distillate Synthesis Process (SNDS). S. T. Sie et al. Catalysis Today. 8 (1991). pp. 371-394.

Dissertation of Glenda Webber. Sep. 2000. pp. 52-58.

Oppenent Shell submission in opposition proceedings against EP-B-1102827. letter dated Nov. 2, 2004, pp. 2 and 16-22.

1996 exchange of corresponding between Shell Malaysia and Yukong.

1996 sales invoice of waxy raffinate to Bentley Chemplax (Australia).

Bill from Showa Shell to General Sekiyu dated Jun. 12, 1997.

Affidavit of Mr. Masami Sakaguchi dated Jun. 17, 2004.

International Showa Shell note dated Oct. 17, 1996 re shipment of Process 011 123X.

1993 Showa Shell brochure on XHVI.

Shell records relating to retained sample of commercial XHVI 5.2 base oil.

1996 exchange of correspondence between Chevron and Shell Malaysia.

Sample Request Form for waxy raffinate Jul. 1996.

ASTM 01160 - Standard Method for Distillation of Petroleum Products at Reduced Pressure. no date.

ASTM 02887 Standard Test Method for Boiling Range Distribution of Petroleum Fractions by Gas Chromatography. no date.

Extract from the website http://www.schu.ac.uk. providing a description of the gas chromatography technique.

Introduction to Organic Laboratory Techniques, D L Pavia et al. 1976. pp. 614-625.

Letter from the Patentee to the EPO dated Jun. 14, 2004 in European Patent Application No. 02716826.9.

Extract from web-site http://www.deh.gov.au. providing a summary of the development of the European Union fuel standard through the years 1993 and 2000 (so-called "Euro-2" and "Euro-3" respectively) and beyond. for petrol (gasoline) and diesel fuel.

Lewis, Sr., Richard J.: Hawley's Condensed Chemical Dictionary, 14th Ed., John Wiley & Sons. New York, 2001 (p. 228).

Ballard. D. H., Generalizing the Hough Transformation to Detect Arbitrary Shapes. Pattern Recognition. vol. 13. No. 2, pp. 111-122. 1981.

Z. Liang & C. S. Hsu, "Molecular Speciation of Saturates by On-Line Liquid Chromotography-Field Ionization Mass Spectrometry", Energy & Fuel. Apr. 1998.

Kirk-Othmer Ency. of Chem. Tech., 3rd Ed., vol. 14, pp. 477-526. no date.

ASTM 086 - Standard Test Method for Distillation of Petroleum Products at Atmospheric Pressure. no date.

M.M.G. Senden, "The Shell Middle Distillate Synthesis Process: Commercial plant experience and outlook into the future", Petrole et Techniques. Aasociation Francaise Des Technic. Paris, Fr., No. 415, Jul. 1998, XP001771962. pp. 94-97.

"Shell Middle Distillate Synthesis", Internet article, XP-002214343. no date.

Fisher-Tropsch Waxes (LeRoux. Oranje) Part I no date.

Sasolwax H1 Certificate of Analysis no date.

Gas Chromatography Analysis of Sasolwax H1.

Letter dated Jun. 14th 2004 from Shell to EPO 02726138.7-2104.

R.M. Mortier & S.T. Orszulik, "Chemistry and Technology of Lubricants", 2nd Ed., pp. 4-5, 1997.

Affidavit of Susan Abernathy, filed in the Opposition to EP1368446. no date.

Affidavit of Dennis O'Rear no date.

SAE Surface Vehicle Standard J300, Rev. Dec. 1999. J. Mass Spectrometry, vol. 31. 383-388 (1996), Klesper & Rollgen.

Register extract for EP20020732741.0.

* cited by examiner

PROCESS TO PREPARE A WAXY RAFFINATE

FIELD OF THE INVENTION

The invention is directed to a process to prepare a waxy raffinate from a Fiseher-Tropsch product. The waxy raffinate product as obtained in this process may find application as a feedstock to prepare a lubricating base oil.

BACKGROUND OF THE INVENTION

Said preparation of the base oil and the preparation of the waxy raffinate product may take place at different locations. Suitably the waxy raffinate product is prepared at the location where the Fischer-Tropsch product is prepared and the lubricating base oil is prepared at a location near the main markets for these products. Generally these locations will be different resulting in that the waxy raffinate products will have to be transported, for example by ship, to the lubricant base oil manufacturing location. This manner of preparing base oils is advantageous because only-one product has to be shipped to the potential base oil and lubricant markets instead of transporting the various base oils grades which may be prepared from the waxy raffinate product.

Prior art base oils as described in for example WO-A-0014179, WO-A-0014183, WO-A-0014187 and WO-A-0014188 comprise at least 95 wt % of non-cyclic isoparaffins. WO-A-0118156 describes a base oil derived from a Fischer-Tropsch product having 10%. Also the base oils as disclosed in applicant's patent applications EP-A-776959 or EP-A-668342 have been found to comprise less than 10 wt % of cyclo-paraffins. Applicants repeated Example 2 and 3 of EP-A-776959 and base oils were obtained, from a waxy Fischer-Tropsch synthesis product, wherein the base oils consisted of respectively about 96 wt % and 93 wt % of iso- and normal paraffins. Applicants further prepared a base oil having a pour point of −21° C. by catalytic dewaxing a Shell MDS Waxy Raffinate (as obtainable from Shell MDS Malaysia Sdn Bhd) using a catalyst comprising synthetic ferrierite and platinum according to the teaching of EP-A-668342 and found that the content of iso- and normal paraffins was about 94 wt %. Thus these prior art base oils derived from a Fischer-Tropsch synthesis product had at least a cyclo-paraffin content of below 10 wt %. Furthermore the base oils as disclosed by the examples of application WO-A-9920720 will not comprise a high cyclo-paraffin content. This because feedstock and preparation used in said examples is very similar to the feedstock and preparation to prepare the above prior art samples based on EP-A-776959 and EP-A-668342.

SUMMARY OF THE INVENTION

Applicants have now found a method to prepare a waxy raffinate product, from which lubricating base oil composition can be prepared having a higher cyclo-paraffin content and a resulting improved solvency when compared to the disclosed base oils. This is found to be advantageous in for example industrial formulations such as turbine oils and hydraulic oils comprising for the greater part the base oil according to the invention. Furthermore the base oil compositions will cause seals in for example motor engines to swell more than the prior art base oils. This is advantageous because due to said swelling less lubricant loss will be observed in certain applications. Applicants have found that such a base oil is an excellent API Group III base oil having improved solvency properties.

DETAILED DESCRIPTION OF THE INVENTION

The invention is directed to the following process. Process to prepare a waxy raffinate product by (a) hydrocracking/hydroisomerisating a Fischer-Tropsch derived feed, wherein weight ratio of compounds having at least 60 or more carbon atoms and compounds having at least 30 carbon atoms in the Fischer-Tropsch product is at least 0.2 and wherein at least 30 wt % of compounds in the Fischer-Tropsch derived feed have at least 30 carbon atoms, (b) isolating from the product of step (a) a waxy raffinate product having a T10 wt % boiling point of between 200 and 450° C. and a T90 wt % boiling point of between 400 and 650° C.

Applicants found that by performing the hydro-cracking/hydroisomerisation step with the relatively heavy feedstock a way raffinate product is obtained from which valuable products may be prepared, such as the base oil product as described in this application. A further advantage is that both fuels, for example gas oil, and a waxy raffinate product suited for preparing base oils are prepared in one hydrocracking/hydroisomerisation process step.

The process of the present invention also results in middle distillates having exceptionally good cold flow properties. These excellent cold flow properties could perhaps be explained by the relatively high ratio iso/normal and especially the relatively high amount of di- and/or trimethyl compounds. Nevertheless, the cetane number of the diesel fraction is more than excellent at values far exceeding 60, often values of 70 or more are obtained. In addition, the sulphur content is extremely low, always less than 50 ppmw, usually less than 5 ppmw and in most case the sulphur content is zero. Further, the density of especially the diesel fraction is less than 800 kg/m$^3$, in most cases a density is observed between 765 and 790 kg/m$^3$, usually around 780 kg/m$^3$ (the viscosity at 100° C. for such a sample being about 3.0 cSt). Aromatic compounds are virtually absent, i.e. less than 50 ppmw, resulting in very low particulate emissions. The polyaromatic content is even much lower than the aromatic content, usually less than 1 ppmw. T95, in combination with the above properties, is below 380° C., often below 350° C.

The process as described above results in middle distillates having extremely good cold flow properties. For instance, the cloud point of any diesel fraction is usually below −18° C., often even lower than −24° C. The CFPP is usually below −20° C., often −28° C. or lower. The pour point is usually below −18° C., often below −24° C.

The relatively heavy Fischer-Tropsch derived feed as used in step (a) has at least 30 wt %, preferably at least 50 wt %, and more preferably at least 55 wt % of compounds having at least 30 carbon atoms. Furthermore the weight ratio of compounds having at least 60 or more carbon atoms and compounds having at least 30 carbon atoms of the Fischer-Tropsch derived feed is at least 0.2, preferably at least 0.4 and more preferably at least 0.55. The Fischer-Tropsch derived feed is preferably derived from a Fischer-Tropsch product which comprises a $C_{20}^+$ fraction having an ASF-alpha value (Anderson-Schulz-Flory chain growth factor) of at least 0.925, preferably at least 0.935, more preferably at least 0.945, even more preferably at least 0.955.

The initial boiling point of the Fischer-Tropsch derived feed may range up to 400° C., but is preferably below 200° C. Preferably at least any compounds having 4 or less carbon atoms and any compounds having a boiling point in that range are separated from a Fischer-Tropsch synthesis product before the Fischer-Tropsch synthesis product is used as a Fischer-Tropsch derived feed in step (a). The Fischer-Tropsch derived feed as described in detail above will for the greater part comprise of a Fischer-Tropsch synthesis product, which has not been subjected to a hydroconversion step as defined according to the present invention. The content of non-branched compounds in the Fischer-Tropsch synthesis product will therefore be above 80 wt %. In addition to this Fischer-Tropsch product also other fractions may be part of the Fischer-Tropsch derived feed. Possible other fractions may suitably be any high boiling fraction obtained in step (b) or any surplus waxy raffinate product, which cannot be shipped away to lubricating manufactures. By recycling this fraction additional middle distillates may be prepared.

Such a Fischer-Tropsch product can be obtained by any process which yields a relatively heavy Fischer-Tropsch product. Not all Fischer-Tropsch processes yield such a heavy product. An example of a suitable Fischer-Tropsch process is described in WO-A-9934917 and in AU-A-698392 both of which are hereby incorporated by reference. These processes may yield a Fischer-Tropsch product as described above.

The Fischer-Tropsch derived feed and the resulting waxy raffinate product will contain no or very little sulphur and nitrogen containing compounds. This is typical for a product derived from a Fischer-Tropsch reaction, which uses synthesis gas containing almost no impurities. Sulphur and nitrogen levels will generally be below the detection limits, which are currently 5 ppm for sulphur and 1 ppm for nitrogen.

The Fischer-Tropsch derived feed may optionally be subjected to a mild hydrotreatment step in order to remove any oxygenates and saturate any olefinic compounds present in the reaction product of the Fischer-Tropsch reaction. Such a hydrotreatment is described in EP-B-668342 hereby incorporated by reference. The mildness of the hydrotreating step is preferably expressed in that the degree of conversion in this step is less than 20 wt % and more preferably less than 10 wt %. The conversion is here defined as the weight percentage of the feed boiling above 370° C., which reacts to a fraction boiling below 370° C. After such a mild hydrotreatroent lower boiling compounds, having four or less carbon atoms and other compounds boiling in that range, will preferably be removed from the effluent before it is used in step (a).

The hydrocracking/hydroisomerisation reaction of step (a) is preferably performed in the presence of hydrogen and a catalyst, which catalyst can be chosen from those known to one skilled in the art as being suitable for this reaction. Catalysts for use in step (a) typically comprise an acidic functionality and a hydrogenation/dehydrogenation functionality. Preferred acidic functionality's are refractory metal oxide carriers. Suitable carrier materials include silica, alumina, silica-alumina, zirconia, titania and mixtures thereof. Preferred carrier materials for inclusion in the catalyst for use in the process of this invention are silica, alumina and silica-alumina. A particularly preferred catalyst comprises platinum supported on a silica-alumina carrier. If desired, applying a halogen moiety, in particular fluorine, or a phosphorous moiety to the carrier, may enhance the acidity of the catalyst carrier. Examples of suitable hydrocracking/hydroisomerisation processes and suitable catalysts are described in WO-A-0014179, EP-A-532118, EP-A-666894 and the earlier referred to EP-A-776959 all are hereby incorporated by reference.

Preferred hydrogenation/dehydrogenation functionalities are Group VIII non-noble metals, for example nickel and cobalt, optionally in combination with molybdenum or copper, and Group VIII noble metals, for example palladium and more preferably platinum or platinum/palladium alloys. The catalyst may comprise the noble metal hydrogenation/dehydrogenation active component in an amount of from 0.005 to 5 parts by weight, preferably from 0.02 to 2 parts by weight, per 100 parts by weight of carrier material. A particularly preferred catalyst for use in the hydroconversion stage comprises platinum in an amount in the range of from 0.05 to 2 parts by weight, more preferably from 0.1 to 1 parts by weight, per 100 parts by weight of carrier material. The catalyst may also comprise a binder to enhance the strength of the catalyst. The binder can be non-acidic. Examples are clays and other binders known to one skilled in the art.

In step (a) the feed is contacted with hydrogen in the presence of the catalyst at elevated temperature and pressure. The temperatures typically will be in the range of from 175 to 380° C., preferably higher than 250° C. and more preferably from 300 to 370° C. The pressure will typically be in the range of from 10 to 250 bar and preferably between 20 and 80 bar. Hydrogen may be supplied at a gas hourly space velocity of from 100 to 10000 Nl/l/hr, preferably from 500 to 5000 Nl/l/hr. The hydrocarbon feed may be provided at a weight hourly space velocity of from 0.1 to 5 kg/l/hr, preferably higher than 0.5 kg/l/hr and more preferably lower than 2 kg/l/hr. The ratio of hydrogen to hydrocarbon feed may range from 100 to 5000 Nl/kg and is preferably from 250 to 2500 Nl/kg.

The conversion in step (a) as defined as the weight percentage of the feed boiling above 370° C. which reacts per pass to a fraction boiling below 370° C., is at least 20 wt %, preferably at least 25 wt %, but preferably not more than 80 wt %, more preferably not more than 70 wt %. The feed as used above in the definition is the total hydrocarbon feed fed to step (a), thus also any optional recycle of the higher boiling fraction as obtained in step (b).

In step (b) the product of step (a) is separated into one or more gas oil fractions, a waxy raffinate product having a T10 wt % boiling point of between 200 and 450° C. and a T90 wt % boiling point of between 400 and 650° C. and more preferably a T90 wt % boiling point of below 550° C. Depending on the conversion in step (a) and the properties of the total feed to step (a) also a higher boiling fraction may be obtained in step (b).

The separation in step (b) is preferably performed by means of a first distillation at about atmospheric-conditions, preferably at a pressure of between 1.2-2 bara, wherein the gas oil product and lower boiling fractions, such as naphtha and kerosine fractions, are separated from the higher boiling fraction of the product of step (a). The higher boiling fraction, of which suitably at least 95 wt % boils above 370° C., is subsequently further separated in a vacuum distillation step wherein a vacuum gas oil fraction, the waxy raffinate product and the higher boiling fraction are obtained. The vacuum distillation is suitably performed at a pressure of between 0.001 and 0.05 bara.

The vacuum distillation of step (b) is preferably operated such that the desired waxy raffinate product is obtained boiling in the specified range and having a kinematic viscosity at 100° C. of preferably between 3 and 10 cSt.

The waxy raffinate product as obtained by the above process has properties, such as pour point and viscosity, which makes it suitable to be transported, suitable by ships, to a lubricating base oil manufacturing location. Preferably the waxy raffinate is stored and transported in the absence of oxygen such to avoid oxidation of the paraffin molecules present in the waxy raffinate product. Suitable nitrogen blanketing is applied during said storage and transport. Preferably the waxy raffinate product has a pour point of above 0° C. This makes it possible to transport the waxy raffinate as a solid by for example keeping the product at ambient temperatures. Transporting the product in the solid state is advantageous because it further limits the ingress of oxygen and thus avoids oxidation. Means to liquefy the product at the unloading facility should be present. Preferably indirect heating means such as steam heated coils are present in the storage tanks, such that the product may be liquefied before being discharged from the tanks. Transport lines are also preferably provided with means to keep the product in a liquid state.

The waxy raffinate product may find various applications. A most suited application is to use the waxy raffinate product as feedstock to prepare lubricating base oils by subjecting the waxy raffinate product to a pour point reducing step. Optionally the waxy raffinate product may be blended with slack wax in order to upgrade the slack wax properties with respect to sulphur, nitrogen and saturates content before subjecting the waxy raffinate to a pour point reducing step.

With a pour point reducing treatment is understood every process wherein the pour point of the base oil is reduced by more than 10° C., preferably more than 20° C., more preferably more than 25° C.

The pour point reducing treatment can be performed by means of a so-called solvent dewaxing process or by means of a catalytic dewaxing process. Solvent dewaxing is well known to those skilled in the art and involves admixture of one or more solvents and/or wax precipitating agents with the waxy raffinate product and cooling the mixture to a temperature in the range of from −10° C. to −40° C., preferably in the range of from −20° C. to −35° C., to separate the wax from the oil. The oil containing the wax is usually filtered through a filter cloth which can be made of textile fibres, such as cotton; porous metal cloth; or cloth made of synthetic materials. Examples of solvents which may be employed in the solvent dewaxing process are $C_3$-$C_6$ ketones (e.g. methyl ethyl ketone, methyl isobutyl ketone and mixtures thereof), $C_6$-$C_{10}$ aromatic hydrocarbons (e.g. toluene), mixtures of ketones and aromatics (e.g. methyl ethyl ketone and toluene), autorefrigerative solvents such as liquefied, normally gaseous $C_2$-$C_4$ hydrocarbons such as propane, propylene, butane, butylene and mixtures thereof. Mixtures of methyl ethyl ketone and toluene or methyl ethyl ketone and methyl isobutyl ketone are generally preferred. Examples of these and other suitable solvent dewaxing processes are described in Lubricant Base Oil and Wax Processing, Avilino Sequeira, Jr, Marcel Dekker Inc., New York, 1994, Chapter 7.

A preferred pour point reducing process is the catalytic dewaxing process. With such a process it has been found that base oils having a pour point of even below −40° C. can be prepared when starting from the waxy raffinate product according to the present process.

The catalytic dewaxing process can be performed by any process wherein in the presence of a catalyst and hydrogen the pour point of the base oil precursor fraction is reduced as specified above. Suitable dewaxing catalysts are heterogeneous catalysts comprising a molecular sieve and optionally in combination with a metal having a hydrogenation function, such as the Group VIII metals. Molecular sieves, and more suitably intermediate pore size zeolites, have shown a good catalytic ability to reduce the pour point of a base oil precursor fraction under catalytic dewaxing conditions. Preferably the intermediate pore size zeolites have a pore diameter of between 0.35 and 0.8 nm. Suitable intermediate pore size zeolites are ZSM-5, ZSM-12, ZSM-22, ZSM-23, SSZ-32, ZSM-35 and ZSM-48. Another preferred group of molecular sieves are the silica-aluminaphosphate (SAPO) materials of which SAPO-11 is most preferred as for example described in U.S. Pat. No. 4,859,311 hereby incorporated by reference. ZSM-5 may optionally be used in its HZSM-5 form in the absence of any Group VIII metal. The other molecular sieves are preferably used in combination with an added Group VIII metal. Suitable Group VIII metals are nickel, cobalt, platinum and palladium. Examples of possible combinations are Ni/ZSM-5, PtIZSM-23, Pd/ZSM-23, Pt/ZSM-48 and Pt/SAPO-11. Further details and examples of suitable molecular sieves and dewaxing conditions are for example described in WO-A-9718278, U.S. Pat. No. 5,053,373, U.S. Pat. No. 5,252,527 and U.S. Pat. No. 4,574,043 all are hereby incorporated by reference.

The dewaxing catalyst suitably also comprises a binder. The binder can be a synthetic or naturally occurring (inorganic) substance, for example clay, silica and/or metal oxides. Natural occurring clays are for example of the montmorillonite and kaolin families. The binder is preferably a porous binder material, for example a refractory oxide of which examples are: alumina, silica-alumina, silica-magnesia, silica-zirconia, silica-thoria, silica-beryllia, silica-titania as well as ternary compositions for example silica-alumina-thoria, silica-alumina-zirconia, silica-alumina-magnesia and silica-magnesia-zirconia. More preferably a low acidity refractory oxide binder material, which is essentially free of alumina, is used. Examples of these binder materials are silica, zirconia, titanium dioxide, germanium dioxide, boria and mixtures of two or more of these of which examples are listed above. The most preferred binder is silica.

A preferred class of dewaxing catalysts comprises intermediate zeolite crystallites as described above and a low acidity refractory oxide binder material which is essentially free of alumina as described above, wherein the surface of the aluminosilicate zeolite crystallites has been modified by subjecting the aluminosilicate zeolite crystallites to a surface dealumination treatment. A preferred dealumination treatment comprises contacting an extrudate of the binder and the zeolite with an aqueous solution of a fluorosilicate salt as described in for example U.S. Pat. No. 5,157,191 or WO-A-0029511 both of which are hereby incorporated by reference. Examples of suitable dewaxing catalysts as described above are silica bound and dealuminated PtIZSM-5, silica bound and dealuminated PtIZSM-23, silica bound and dealuminated Pt/ZSM-12, silica bound and dealuminated Pt/ZSM-22, as for example described in WO-A-0029511 and EP-B-832171 hereby incorporated by reference.

Catalytic dewaxing conditions are known in the art and typically involve operating temperatures in the range of from 200 to 500° C., suitably from 250 to 400° C., hydrogen pressures in the range of from 10 to 200 bar, preferably from 40 to 70 bar, weight hourly space velocities (WHSV) in the range of from 0.1 to 10 kg of oil per litre of catalyst per hour (kg/l/hr), suitably from 0.2 to 5 kg/l/hr, more suitably from 0.5 to 3 kg/l/hr and hydrogen to oil ratios in the range of from 100 to 2,000 litres of hydrogen per litre of oil. By varying the temperature between 275, suitably between 315 and 375° C. at between 40-70 bars, in the catalytic dewaxing step it is possible to prepare base oils having different pour point specifications varying from suitably −10 to −60° C.

The effluent or separate boiling fractions of the catalytic or solvent dewaxing step are optionally subjected to an additional hydrogenation step, also referred to as a hydrofinishing step for example if the effluent contains olefins or when the product is sensitive to oxygenation or when colour needs to be improved. This step is suitably carried out at a temperature between 180 and 380° C., a total pressure of between 10 to 250 bar and preferably above 100 bar and more preferably between 120 and 250 bar. The WHSV (Weight hourly space velocity) ranges from 0.3 to 2 kg of oil per litre of catalyst per hour (kg/l.h).

The hydrogenation catalyst is suitably a supported catalyst comprising a dispersed Group VIII metal. Possible Group VIII metals are cobalt, nickel, palladium and platinum. Cobalt and nickel containing catalysts may also comprise a Group VIB metal, suitably molybdenum and tungsten. Suitable carrier or support materials are low acidity amorphous refractory oxides. Examples of suitable amorphous refractory oxides include inorganic oxides, such as alumina, silica, titania, zirconia, boria, silica-alumina, fluorided alumina, fluorided silica-alumina and mixtures of two or more of these.

Examples of suitable hydrogenation catalysts are nickel-molybdenum containing catalyst such as KF-847 and KF-8010 (AKZO Nobel) M-8-24 and M-8-25 (BASF), and C-424, DN-190, HDS-3 and HDS-4 (Criterion); nickel-tungsten containing catalysts such as NI-4342 and NI-4352 (Engelhard) and C-454 (Criterion); cobalt-molybdenum containing catalysts such as KF-330 (AKZO-Nobel), HDS-22 (Criterion) and HPC-601 (Engelhard). Preferably platinum containing and more preferably platinum and palladium containing catalysts are used. Preferred supports for these palladium and/or platinum containing catalysts are amorphous silica-alumina. Examples of suitable silica-alumina carriers are disclosed in WO-A-9410263 hereby incorporated by reference. A preferred catalyst comprises an alloy of palladium and platinum preferably supported on an amorphous silica-alumina carrier of which the commercially available catalyst C-624 of Criterion Catalyst Company (Houston, Tex.) is an example.

The dewaxed product is suitable separated into one or more base oil products having different viscosities by means of distillation, optionally in combination with an initial flashing step. The separation into the various fractions may suitably be performed in a vacuum distillation column provided with side stripers to separate the fraction from said column. In this mode it is found possible to obtain for example a base oil having a viscosity between 2-3 cSt, a base oil having a viscosity between 4-6 cSt and a base oil having a viscosity between 7-10 cSt product simultaneously from a single waxy raffinate product (viscosities as kinematic viscosity at 100° C.). By straightforward optimising the product slate and minimising the amount of non-base oil intermediate fractions it has been found possible to prepare base oils in a sufficiently high yield having a good Noack volatility properties. For example, base oils having a kinematic viscosity at 100° C. of between 3.5 and 6 cSt have been obtained which have a Noack volatility of between 6 and 14 wt %.

It has been found that a lubricating base oil can be prepared starting from this waxy raffinate product which base oil comprises preferably at least 98 wt % saturates, more preferably at least 99.5 wt % saturates and most preferably at least 99.9 wt %. This saturates fraction in the base oil comprises between 10 and 40 wt % of cyclo-paraffins. Preferably the content of cyclo-paraffins is less than 30 wt % and more preferably less than 20 wt %. Preferably the content of cyclo-paraffins is at least 12 wt %. The unique and novel base oils are further characterized in that the weight ratio of 1-ring cyclo-paraffins relative to cyclo-paraffins having two or more rings is greater than 3 preferably greater than 5. It was found that this ratio is suitably smaller than 15.

The cyclo-paraffin content as described above is measured by the following method. Any other method resulting in the same results may also be used. The base oil sample is first separated into a polar (aromatic) phase and a non-polar (saturates) phase by making use of a high performance liquid chromatography (HPLC) method IP368/01, wherein as mobile phase pentane is used instead of hexane as the method states. The saturates and aromatic fractions are then analyzed using a Finnigan MAT90 mass spectrometer equipped with a Field desorption/Field Ionisation (FD/FI) interface, wherein FI (a "soft" ionisation technique) is used for the semi-quantitative determination of hydrocarbon types in terms of carbon number and hydrogen deficiency. The type classification of compounds in mass spectrometry is determined by the characteristic ions formed and is normally classified by "z number". This is given by the general formula for all hydrocarbon species: $C_nH_{2n+z}$. Because the saturates phase is analysed separately from the aromatic phase it is possible to determine the content of the different (cyclo)-paraffins having the same stoichiometry. The results of the mass spectrometer are processed using commercial software (poly 32; available from Sierra Analytics LLC, 3453 Dragoo Park Drive, Modesto, Calif. GA95350 USA) to determine the relative proportions of each hydrocarbon type and the average molecular weight and polydispersity of the saturates and aromatics fractions.

The base oil composition preferably has a content of aromatic hydrocarbon compounds of less than 1 wt %, more preferably less than 0.5 wt % and most preferably less than 0.1 wt %, a sulphur content of less than 20 ppm and a nitrogen content of less than 20 ppm. The pour point of the base oil is preferably less than −30° C. and more preferably lower than −40° C. The viscosity index is higher than 120. It has been found that the novel base oils typically have a viscosity index of below 140.

The base oils itself may find application as part of for example an Automatic Transmission Fluids (ATF), automotive (gasoline or diesel) engine oils, turbine oils, hydraulic oils, electrical oils or transformer oils and refrigerator oils.

The invention will be illustrated with the following non-limiting examples.

EXAMPLE 1

A waxy raffinate product was obtained by feeding continuously a $C_5$-$C_{750}$° C.$^+$ fraction of the Fischer-Tropsch product, as obtained in Example VII using the catalyst of Example III of WO-A-9934917 to a hydrocracking step (step (a)). The feed contained about 60 wt % $C_{30}$+ product. The ratio $C_{60}$+/$C_{30}$+ was about 0.55. In the hydrocracking step the fraction was contacted with a hydrocracking catalyst of Example 1 of EP-A-532118.

The effluent of step (a) was continuously distilled to give lights, fuels and a residue "R" boiling from 370° C. and above. The yield of gas oil fraction on fresh feed to hydrocracking step was 43 wt %. The main part of the residue "R" was recycled to step (a) and a remaining part was separated by means of a vacuum distillation into a waxy raffinate product having the properties as in Table 1 and a fraction boiling above 510° C.

The conditions in the hydrocracking step (a) were: a fresh feed Weight Hourly Space Velocity (WHSV) of 0.8 kg/l.h, recycle feed WHSV of 0.2 kg/l.h, hydrogen gas rate=1000 Nl/kg, total pressure=40 bar, and a reactor temperature of 335° C.

TABLE 1

| | |
|---|---|
| Density at 70° C. (kg/m$^3$) | 779.2 |
| vK@100 (cSt) | 3.818 |
| pour point (° C.) | +18 |
| Boiling point data as | 5% 355° C. |
| temperature at which a | 10% 370° C. |
| wt % is recovered. | 50% 419° C. |
| | 90% 492° C. |
| | 95% 504° C. |

EXAMPLE 2

The waxy raffinate product of Example 1 was dewaxed to prepare a base oil by contacting the product with a dealuminated silica bound ZSM-5 catalyst comprising 0.7% by weight Pt and 30 wt % ZSM-5 as described in Example 9 of WO-A-0029511. The dewaxing conditions were 40 bar hydrogen, WHSV=1 kg/l.h and a temperature of 340° C.

The dewaxed oil was distilled into three base oil fractions: boiling between 378 and 424° C. (yield based on feed to dewaxing step was 14.2 wt %), between 418-455° C. (yield based on feed to dewaxing step was 16.3 wt %) and a fraction boiling above 455° C. (yield based on feed to dewaxing step was 21.6 wt %). See Table 2 for more details.

TABLE 2

| | Light Grade | Medium Grade | Heavy Grade |
|---|---|---|---|
| density at 20° C. | 805.8 | 814.6 | 822.4 |
| pour point (° C.) | <−63 | <−51 | −45 |
| kinematic viscosity at 40° C. (cSt) | | 19.06 | 35.0 |
| kinematic viscosity at 100° C. (cSt) | 3.16 | 4.144 | 6.347 |
| VI | n.a. | 121 | 134 |
| Noack volatility (wt %) | n.a. | 10.8 | 2.24 |
| sulphur content (ppm) | <1 ppm | <1 ppm | <5 ppm |
| saturates (% w) | n.a. | 99.9 | n.a. |
| Content of cyclo-paraffins (wt %) (*) | n.a. | 18.5 | n.a. |
| Dynamic viscosity as measured by CCS at −40° C. | n.a. | 3900 cP | n.a. |

(*) as determined by means of a Finnigan MAT90 mass spectrometer equipped with a Field desorption/field ionisation interface on the saturates fraction of said base oil.
n.a.: not applicable
n.d.: not determined

EXAMPLE 3

Example 2 was repeated except that the dewaxed oil was distilled into the different three base oil products of which the properties are presented in Table 3.

TABLE 3

| | Light Grade | Medium Grade | Heavy Grade |
|---|---|---|---|
| density at 20° C. | 809.1 | 817.2 | 825.1 |
| pour point (° C.) | <−63 | <−51 | −39 |
| kinematic viscosity at 40° C. (cSt) | | 23.32 | 43.01 |
| kinematic viscosity at 100° C. (cSt) | 3.181 | 4.778 | 7.349 |
| VI | n.a. | 128 | 135 |
| Noack volatility (wt %) | n.a. | 7.7 | n.a. |
| sulphur content (ppm) | <5 ppm | <5 ppm | <5 ppm |
| saturates (% w) | | 99.0 | |
| Dynamic viscosity as measured by CCS at −40° C. | | 5500 cP | |
| Yield based on feed to cat dewaxing step (wt %) | 15.3 | 27.4 | 8.9 |

EXAMPLE 4

Example 2 was repeated except that the that the dewaxed oil was distilled into the different three base oil products and one intermediate raffinate (I.R.) of which the properties are presented in Table 4.

TABLE 4

| | Light Grade | I.R. | Medium Grade | Heavy Grade |
|---|---|---|---|---|
| density at 20° C. | 806 | 811.3 | 817.5 | 824.5 |
| pour point (° C.) | <−63 | −57 | <−51 | −39 |
| Kinematic viscosity at 40° C. (cSt) | 10.4 | | 23.51 | 42.23 |
| Kinematic viscosity at 100° C. (cSt) | 2.746 | 3.501 | 4.79 | 7.24 |
| VI | 103 | | 127 | 135 |
| Noack volatility | n.a. | | 6.8 | 1.14 |
| sulphur content (ppm) | <5 ppm | | <5 ppm | <5 ppm |
| Saturates (% w) | n.d. | | 99.5 | |
| Dynamic viscosity as measured by CCS at −40° C. | | | 5500 cP | |
| Yield based on CDW feed | 22.6 | 8.9 | 22.6 | 11.1 |

n.a.: not applicable
n.d.: not determined

Examples 2-4 illustrate that from the waxy raffinate product as obtained by the process of the present invention base oils are prepared in a high yield and wherein the base oils have excellent viscometric properties.

We claim:

1. A process to prepare a waxy raffinate product comprising (a) hydrocracking/hydroisomerizing a Fischer-Tropsch derived feed, to produce a Fischer-Tropsch product wherein weight ratio of compounds having at least 60 or more carbon atoms and compounds having at least 30 carbon atoms in the Fischer-Tropsch product is at least 0.4 and wherein at least 30 wt % of compounds in the Fischer-Tropsch derived feed have at least 30 carbon atoms; and, (b) isolating from the product of step (a) a waxy raffinate product having a T10 wt % boiling point of between 200° C. and 450° C. and a T90 wt % boiling point of between 400° C. and 650° C.

2. The process of claim 1, wherein at least 50 wt % of compounds in the Fischer-Tropsch derived feed have at least 30 carbon atoms.

3. The process of claims 1, wherein the Fischer-Tropsch derived feed is derived from a Fischer-Tropsch product comprising a $C_{20}^{+}$ fraction having an ASF-alpha value (Anderson-Schulz-Flory chain growth factor) of at least 0.925.

4. The process of claims 1, wherein the conversion in step (a) is between 25 wt % and 70 wt %.

5. The process of claims 1, wherein the T90 wt % boiling point of the waxy raffinate product is below 550° C.

6. The process of claims 1, wherein the waxy raffinate product has a kinematic viscosity at 100° C. of between 3 cSt and 10 cSt.

7. A process for preparing lubricating base oils comprising:

(a) preparing a waxy raffinate product by the process comprising (i) hydrocracking/hydroisomerizing a Fischer-Tropsch derived feed, to produce a Fischer-Tropsch product wherein weight ratio of compounds having at least 60 or more carbon atoms and compounds having at least 30 carbon atoms in the Fischer-Tropsch product is at least 0.4 and wherein at least 30 wt % of compounds in the Fischer-Tropsch derived feed have at least 30 carbon atoms; and, (ii) isolating from the product of step (a) a waxy raffinate product having a T10 wt % boiling point of between 200° C. and 450° C. and a T90 wt % boiling point of between 400° C. and 650° C.

(b) subjecting the waxy raffinate from step (a) to a pour point reducing step to produce a dewaxed product.

8. The process of claim 7, wherein the pour point reducing step comprises catalystic dewaxing.

9. The process of claim 7, further comprising:

(b) distilling the dewaxed product into one or more fractions.

10. The process of claim 9, wherein one of the fractions from step (c) comprises at least 98 wt % saturates.

11. The process of claim 10, wherein the fraction comprising at least 98 wt % saturated comprises between 12 wt % and 20 wt % cyclo-paraffins.

12. The process of claim 7, further comprising transporting the waxy raffinate product to a location for pour point reduction wherein the waxy raffinate has a pour point of 0° C. and is under nitrogen blanketing during transportation.

* * * * *